US005503340A

United States Patent [19]

Doppstadt

[11] Patent Number: 5,503,340

[45] Date of Patent: Apr. 2, 1996

[54] ARCUATE IMPACT PLATE AND COMMINUTING MACHINE WITH ARCUATE IMPACT PLATE

[76] Inventor: Werner Doppstadt, Vossnacker Strasse 67, 42555 Velbert, Germany

[21] Appl. No.: 215,523

[22] Filed: Mar. 22, 1994

[30] Foreign Application Priority Data

Apr. 7, 1993 [DE] Germany ..... 9305306 U

[51] Int. Cl.[6] ..... B02C 13/09

[52] U.S. Cl. ..... 241/189.1; 241/300.1

[58] Field of Search ..... 241/101.7, 189.1, 241/287, 300.1

[56] References Cited

U.S. PATENT DOCUMENTS

| | | | |
|---|---|---|---|
| 1,021,906 | 4/1912 | Tomlinson | 241/88.2 |
| 1,125,137 | 1/1915 | Liggett . | |
| 1,307,761 | 6/1919 | Shelton | 241/88.2 |
| 1,354,855 | 10/1920 | Simpson | 241/88.2 |
| 1,420,354 | 6/1922 | Williams | 241/189.1 |
| 1,683,304 | 9/1928 | Roebke | 241/86 X |
| 1,703,211 | 2/1929 | Schmierer | 241/300.1 X |
| 2,317,909 | 4/1943 | Gruendler | 241/88.4 |
| 2,530,313 | 11/1950 | Parten | 241/88.2 X |
| 2,678,169 | 5/1954 | Tullis | 241/14 X |
| 4,146,184 | 3/1979 | Whitney | 241/89.2 X |
| 4,852,816 | 8/1989 | Doppstadt . | |

FOREIGN PATENT DOCUMENTS

| | | |
|---|---|---|
| 212194 | 7/1986 | European Pat. Off. . |
| 2902257 | 7/1980 | Germany . |
| 1230678 | 5/1986 | U.S.S.R. . |

*Primary Examiner*—Timothy V. Eley
*Attorney, Agent, or Firm*—Collard & Roe

[57] ABSTRACT

The comminuting machine includes a housing provided with a rotary impact mechanism. A conveyor conveys infed material to the rotary impact mechanism which cooperates with an arcuate impact plate in disintegrating the infed material. The comminuted material is discharged through a discharge opening of the housing. On an inner side of the arcuate impact plate parallel rows of teeth extend transversely to the rotational direction of the rotary impact mechanism. The teeth rows are transversely and lengthwisely offset from each other. The individual teeth protrude in opposition to the rotational direction and decrease in height in the rotational direction. The arcuate impact plate extends eccentrically in relation to the rotary impact mechanism and the tips of the teeth conjointly with the rotary impact mechanism define a throughpass gap for the material to be comminuted. A cover plate may be linked to the arcuate impact plate for closing the discharge opening and for downwardly deflecting comminuted material in the open condition.

27 Claims, 5 Drawing Sheets

ARCUATE IMPACT PLATE AND COMMINUTING MACHINE WITH ARCUATE IMPACT PLATE

CROSS-REFERENCE TO RELATED APPLICATION

This application is related to my copending United States patent applications Ser. No. 08/215,326 filed Mar. 21, 1994, entitled "Mobile Material Processing Machine With Tandem Axle"; Ser. No. 08/215,521, filed Mar. 22, 1994, entitled "Comminuting Machine With Comminution Grates"; Ser. No. 08/217,388, filed Mar. 22, 1994, entitled "Comminution Machine With Comminution Cover Plate"; Ser. No. 08/217,377, filed Mar. 24, 1994, entitled "Comminuting Machine With Comb-like Further Comminution Structure"; and Ser. No. 08/217,372, filed Mar. 24, 1994, and entitled "Infeed Construction For Comminuting Machines".

BACKGROUND OF THE INVENTION

The present invention relates to a new and improved construction of an arcuate impact plate and a comminuting machine including such arcuate impact plate.

In its more particular aspects, the present invention specifically relates to a new and improved construction of a comminuting machine for comminuting waste and, more particularly, waste wood material intended to be composted. Generally, such machines are mounted at a mobile support frame and comprise a housing in the form of a container for receiving the material to be comminuted. A conveyor is disposed in the housing or container for conveying the infed material to a rotary impact mechanism. The rotary impact mechanism cooperates with an impact plate in a comminuting section which precedes a discharge opening of the housing or container for discharging the comminuted material under the action of the rotary impact mechanism. The impact plate may be followed by further comminuting means through which the comminuted material is discharged with further comminution. The comminuted material may be deposited in stacks or pits for composting.

A comminuting machine or composting equipment such as known, for example, from U.S. Pat. No. 4,852,816, granted on Aug. 1, 1989, to the applicant of the instant application, is constructed for comminuting organic or wood waste originating in forestry, municipality or building operations. A trough-shaped container receives the material to be comminuted, for example, by means of a shovel loader. Infeed means are provided in the form of an infeed conveyor which is located above the bottom of the container and feeds the material to a rotary impact mechanism which drives the infed material through an entrance gap defined between an impact ledge and rotating flails of the rotary impact mechanism. The impact ledge is followed by retainer claws which extend between adjacent ones of the rotating flails for comminuting the material which has been forced through the entrance gap. An impact plate follows the retainer claws and has teeth protruding toward the rotating flails and cooperating therewith for further comminuting the material prior to its discharge through a discharge opening from a rear part of the container.

In a further development (Doppstadt shredder, type AK 330) of the aforementioned comminuting machine the infeed means further include an intake roll which bears upon the infed material from above. The entrance gap is followed by an impact plate containing two plate sections. The two plate sections are arranged at an angle with respect to each other so that the impact plate extends along an upper part of the cylindrical action area of the rotating flails of the rotary impact mechanism. The rotating flails are arranged at a drum in axial rows such that one axial row of rotating flails is axially offset from the adjacent axial row of rotating flails and the rotating flails define a substantially uninterrupted cylindrical area of action. Teeth protrude from the impact plate toward the rotating flails and are arranged in parallel rows transverse with respect to the rotational direction of the rotating flails, the rows of teeth being transversely offset from each other. There is thus defined a throughpass gap through which the incoming material is forced under the action of the rotating flails and subjected to comminuting action. The impact plate may be immediately followed by further comminuting means disposed laterally of the rotary impact mechanism and placed at the discharge opening of the container. This further comminuting means is formed by a comb-like frame containing upper and lower traverses; generally arcuately shaped struts extend between upper and lower traverses in a spaced parallel relationship to each other and have teeth protruding upwardly in opposition to the rotating flails. The comminuted material is thereby subjected to further comminution and forced out through the spaces existing between the struts. The further comminuting means is pivotally mounted by means of the upper traverse.

In both of the aforementioned comminuting machines the impact plate as well as the further comminuting means is pivotably supported so as to pivot away from the rotating flails in the event that the infed material contains pieces of material which do not disintegrate under the action of the rotating flails in cooperation with the impact plate. The rotary impact mechanism and the impact plate are thus prevented from damage by pieces of non-disintegratable material. Hydraulic displacement means are provided in the Doppstadt AK 330 shredder on the outer side of the impact plate and linked to the further comminuting means for displacing the same between an operative position, in which the container discharge opening is covered thereby, and an inoperative position, in which the further comminuting means is pivoted away from the container discharge opening.

Furthermore, both of the aforementioned comminuting machines are mobile machines mounted at a support frame on wheels. Such wheel support can be provided by supporting the comminuting machine on a truck such as known from European Pat. No. 0,212,194, the grant of which to the applicant of the instant application was published on Oct. 11, 1987; in such construction the engine of the truck als serves to drive the comminuting machine. The wheel supported support frame may also carry the drive means for operating the comminuting machine; as described in the aforementioned U.S. patent, such comminuting machine may be displaced at a given working location by means of the shovel loader used for charging the comminuting machine. The support frame may also be supported at a tandem axle. Pressure fluid operated drive means acting upon the front wheels of the tandem axle may be provided for displacing the comminuting machine at the working location (Doppstadt shredder AK 330). Remote control means may be used for controlling the operation of the comminuting machine including the pressure fluid operated drive means. While the machine can be operated in this manner independent of a truck, travel to a different working location requires connection to a towing vehicle like a tractor or truck.

Still further, both of the aforementioned mobile comminuting machines are equipped with overload coupling and/or overload control means which are responsive to deceleration of the rotary impact mechanism in the presence of excessive infed material to be comminuted. Such overload coupling mainly serves to dampen rapid transient variations in the rotational speed of the rotary impact mechanism due to a momentary overload so that the same do not or only little affect the prime mover. The overload control means react to the overload by decelerating and eventually stopping the infeed drive means as a function of the rotational speed of the rotary impact mechanism.

A stationary comminuting machine such as known, for example, from German Published Patent Application No. 2,902,257, published on Jul. 31, 1980, is intended for comminuting particularly confidential files but also waste materials of any kind including waste wood. Infeed means like infeed rolls feed the material to be comminuted to an inlet gap and into the interior of a drum-like housing. Parts of the infed material protrude through the inlet gap and are severed or chopped off by a rotary impact mechanism. The drum-like housing of the comminuting machine accommodates a basically segment-shaped impact body defining a throughpass gap in cooperation with a rotary impact mechanism. The throughpass gap narrows from an inlet for infeeding the material to be comminuted to an outlet and extends around the upper half of the rotary impact mechanism. The impact body is mounted at the drum-like housing by means of bolts permitting adjustment of the impact body in radial direction relative to the rotary impact mechanism. At its rear end, as viewed in the rotational direction of the rotary impact mechanism, the impact body bears upon a stop. The impact body is provided on its inner side with a, for example, saw-tooth profile which extends parallel to the axis of the rotary impact mechanism. The impact body is followed in the rotational direction of the rotary impact mechanism by grate means which extends around the lower half of the rotary impact mechanism and defines a throughpass gap which narrows in the rotational direction. The comminuted material issuing from the throughpass gap is driven by the rotary impact mechanism through the grate means and forced out through the grate openings.

A stationary comminuting machine or pulverizer such as known, for example, from U.S. Pat. No. 1,125,137 is constructed as a hammer mill into which the material to be comminuted is dropped from the top. The incoming material is hit by a rotary shaft with spiders extending radially therefrom and provided with swinging hammers at their free ends. The hammers cooperate with different breaking plates extending in sequence around part of the circumference defined by the rotating hammers. A first breaking plate presents a smooth surface to the rotating hammers; a second breaking plate is provided with a sequence of teeth formed by faces which rise from the plate in the direction of rotation of the rotating hammers; a third breaking plate extends along the lower half of the circumference described by the rotating hammers and contains a number of bars arranged at an angle relative to the associated faces of the rotating hammers. The spaces between the bars serve as discharge openings for the comminuted material. A section of the support structure for the bars of the third breaking plate can be pivoted away from the circumference described by the rotating hammers by manually operated pivot means in order to permit removal of material which can not be sufficiently reduced.

In a further known stationary comminuting machine such as a hammer mill known from USSR Author Certificate No. 1,230,678, published May 15, 1986, the material to be comminuted is dropped from the top onto rotating hammers of a rotor which cooperate first with an impact plate which is arranged above the rotating hammers and extends generally in the direction of rotation of the rotating hammers. The impact plate is provided with transversely and lengthwisely extending ribs protruding toward the rotating hammers. A second impact plate follows the first impact plate at an obtuse angle relative thereto; this second impact plate is provided with angular impact elements defining tips which are directed toward the rotating hammers. This second impact plate is immediately followed by a third, planar impact plate downwardly inclined toward the rotor. Finally, a grate immediately follows the third impact plate and semicylindrically surrounds the lower half of the rotor. The comminuted material is forced and discharged through the grate under the action of the rotating hammers.

Contrary to the first mentioned mobile waste comminuting machines, the last mentioned stationary comminuting machines are not provided with any means permitting the impact plates and other structures which cooperate with the rotating hammers, to yield in the presence of non-disintegratable material.

Regarding the aforementioned mobile waste comminuting machines, the comminuting action realized therein has been found to be unsatisfactory with respect to the comminution efficiency of the impact plate.

SUMMARY OF THE INVENTION

Therefore, with the foregoing in mind, it is a primary object of the present invention to provide a new and improved construction of an impact plate and a comminuting machine which are not afflicted with the drawbacks and limitations of the prior art constructions heretofore discussed.

Another and more specific object of the invention is directed to the provision of a new and improved construction of an impact plate and a comminuting machine which have a higher comminution efficiency than the prior art constructions.

Now in order to implement these and still further objects of the invention, which will become more readily apparent as the description proceeds, the impact plate of the present development is manifested by the features that, among other things, an arcuate impact plate extends along an arc enclosing an angle in the range of 40° to 120° and having an inner side which is provided with substantially transverse teeth rows disposed at a transverse and lengthwise offset from each other.

As alluded to above, the invention is also concerned with a comminuting machine containing a housing, a rotary impact mechanism accommodated in the housing, an impact plate having a front end as viewed in the rotational direction of the rotary impact mechanism, which front end is pivotably supported at opposite side walls of the housing so as to be pivotable about a pivot axis extending substantially parallel to the rotational axis of the rotary impact mechanism, the impact plate further having a rear end as viewed in the rotational direction of the rotary impact mechanism, which rear end bears upon stops at the side walls of the housing, and teeth at the inner side of the impact plate, which teeth protrude therefrom in opposition to the rotational direction of the rotary impact mechanism. The present development of such comminuting machine is distinguished, among other things, by the following features:

the arcuate impact plate extends over an arc in the range of 40° to 120° along an upper portion of the rotary impact mechanism; the arcuate impact plate is eccentrically arranged with respect to the rotary impact mechanism and defines conjointly therewith a throughpass gap which narrows toward the rear end of the arcuate impact plate; the teeth at the inner side of the arcuate plate are arranged in transverse rows which are substantially transversely offset from each other in a manner such that the teeth rows are free of lengthwise rows of teeth.

As a result of the construction of the arcuate plate and its arrangement in the inventive comminuting machine, the comminuting efficiency is markedly increased due to the fact that the comminuting action of the rotary impact mechanism on the infed material in conjunction with the protruding teeth of the arcuate impact plate is intensified. This is the result of the arcuate shape of the impact plate which increases the length of the throughpass gap in which the comminution occurs; also, the particular arrangement of the rows of teeth has the consequence that any slip-through of material is prevented because there is no lengthwise alignment of the teeth.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

BRIEF DESCRIPTION OF THE PREFERRED EMBODIMENTS

Figure 1:
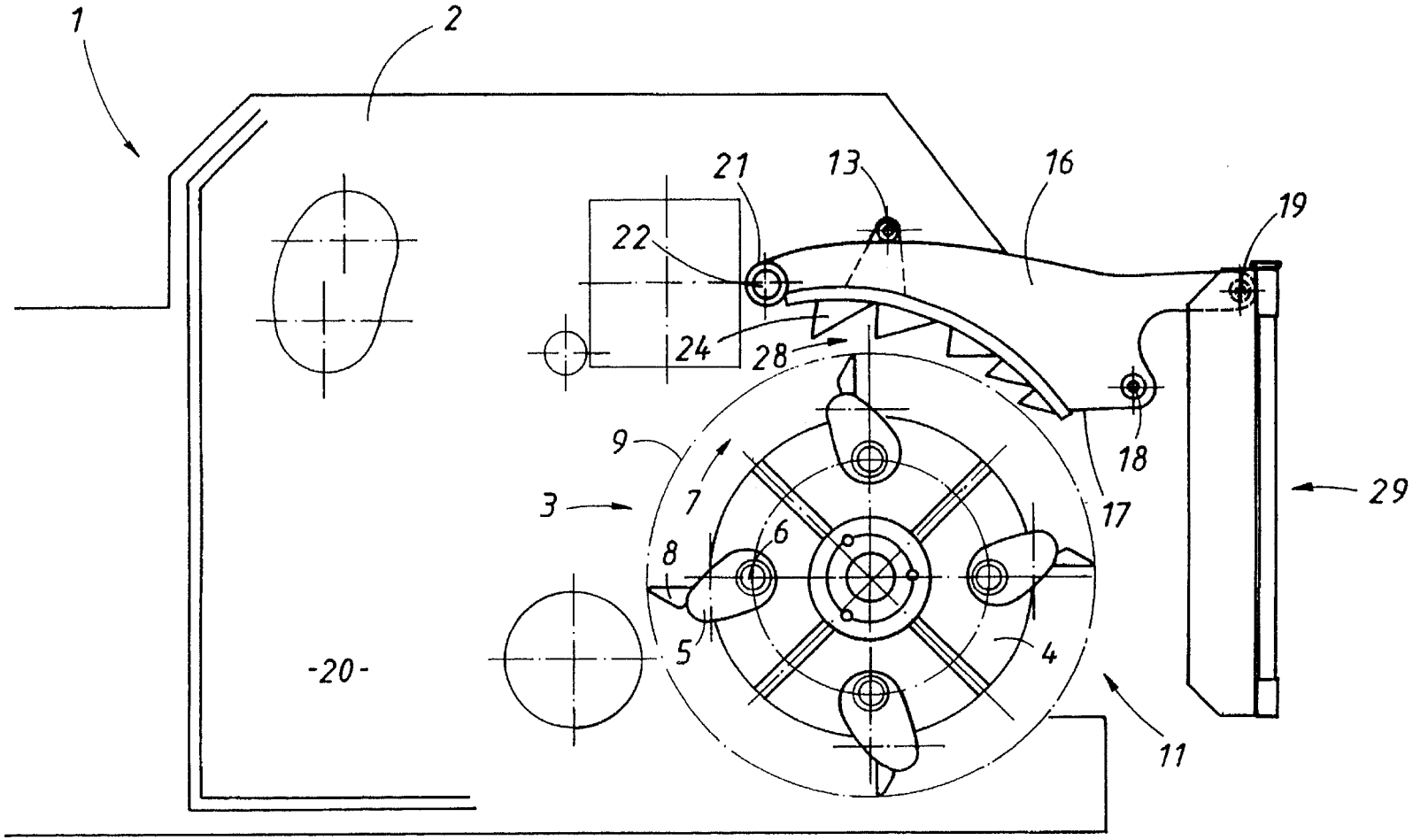
FIG. 1 is a schematic, partially sectional side view of an exemplary embodiment of the inventive comminuting machine.

Describing now the drawings, it is to be understood that only enough of the construction of the arcuate impact plate and the comminuting machine in which such arcuate impact plate is installed, has been shown as needed for those skilled in the art to readily understand the underlying principles and concepts of the present development, while simplifying the showing of the drawing. Generally, the inventive comminuting machine includes a stationary or mobile housing which houses a rotary impact mechanism and receives the material to be comminuted. The drawings specifically show examples of a waste wood comminuting machine for comminuting waste wood of the type as occurring in forestry, municipality and building or constructing operations. While the illustrated exemplary embodiment are concerned with a mobile machine of this type which is supported at a wheel-supported support frame which also carries the drive means for operating the machine, it will be understood that the inventive construction can also be realized in connection with a truck supported mobile comminuting machine. Also, the illustrated exemplary embodiment may be provided with independent drive means as disclosed in the initially cross-referenced, copending U.S. patent application. Naturally, the inventive construction is not limited to the illustrated example of waste wood comminuting machines but can also be realized in connection with comminuting machines for processing other kinds of material and based on the same basic constructional principles.

Turning attention now to FIG. 1 of the drawings, there has been shown in a schematic, partially sectional side view a comminuting machine 1 and a housing 2 thereof. This housing 2 may constitute, for example, the rear part of a trough-shaped container having a not particularly illustrated central portion which receives the material to be comminuted. Conveying means such as a scraper conveyor and an intake roll convey the infed material to this rear part which houses the actual comminuting mechanism to be described hereinbelow. In a front part (not shown) of the comminuting machine, there may be located drive means for operating the comminuting machine. Such drive means may comprise, for example, a diesel engine representing the prime mover and a hydraulic drive system including an axial piston pump which is in driving connection with the prime mover and which supplies hydraulic oil to various hydraulically operated components of the comminuting machine.

The actual comminuting mechanism is accommodated by the housing or container rear part 2. This comminuting mechanism is constituted by a rotary impact mechanism 3 which contains a drum 4 equipped with flails 5 each of which is pivotably supported about a pivot axis 6. During revolution of the drum 4 in the rotational direction as indicated by the arrow 7, the flails 5 are subject to a centrifugal force and pivot outwardly in known manner. As a result, cutting members 8 of the flails 5 define a substantially cylindrical area 9 of action. The flails 5 are arranged in axial rows which are offset from each other in order to form a substantially uninterrupted cylindrical area 9 of action as described with respect to the aforementioned Doppstadt AK 330 shredder. The material to be comminuted is infed into the area 9 of action of the rotary impact mechanism 3 by means of, for example, a conveying device like the initially mentioned scraper conveyor.

An arcuate impact plate 10 to be described in more detail hereinbelow is arranged in the container rear part 2 for cooperation with the rotary impact mechanism 3. The arcuate impact plate 10 follows the known entrance gap which is defined between the rotary impact mechanism 3 and an impact ledge which extends across the container rear part 2. The arcuate impact plate 10 extends along a top portion of the rotary impact mechanism 3. A throughpass gap 28 is defined therebetween and leads to a discharge opening 11 through which the comminuted material is discharged in order to form stacks or pits of the comminuted material for composting.

Figure 2:
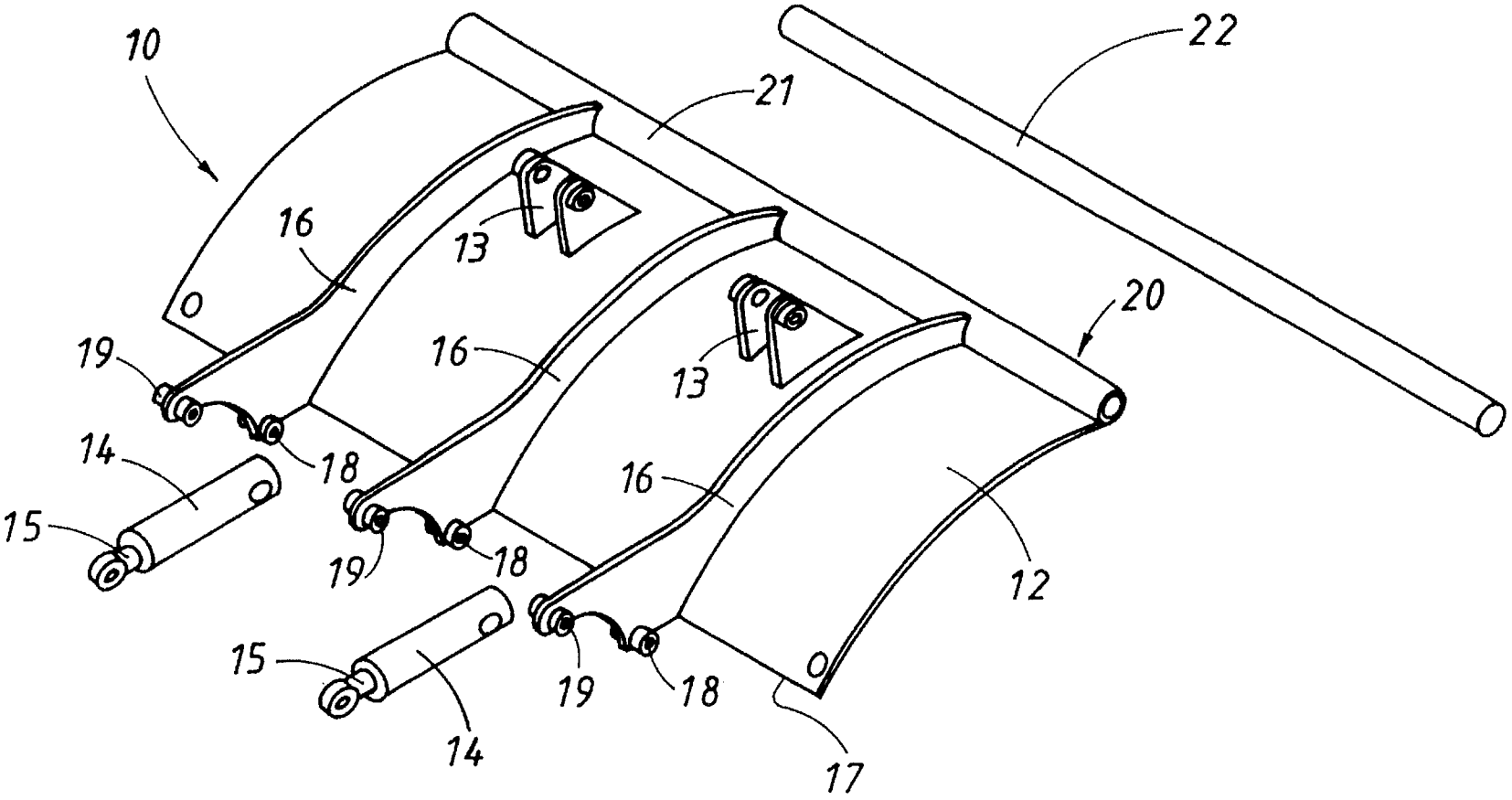
FIG. 2 is a perspective view of the outer side of an arcuate impact plate used in the comminuting machine as shown in FIG. 1.
Figure 3:
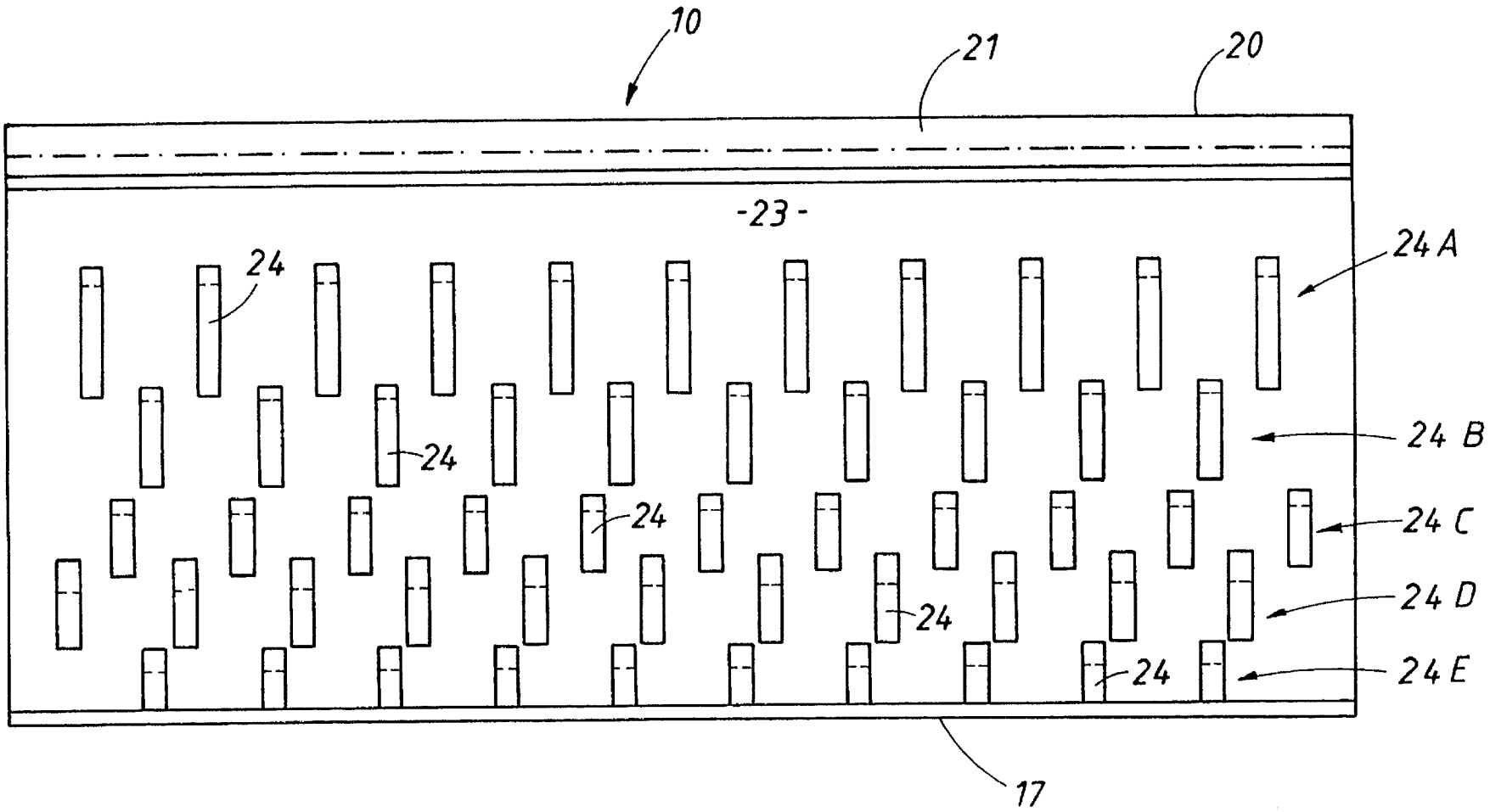
FIG. 3 is a top plan view of the inner side of the arcuate impact plate as shown in FIG. 2.
Figure 4:
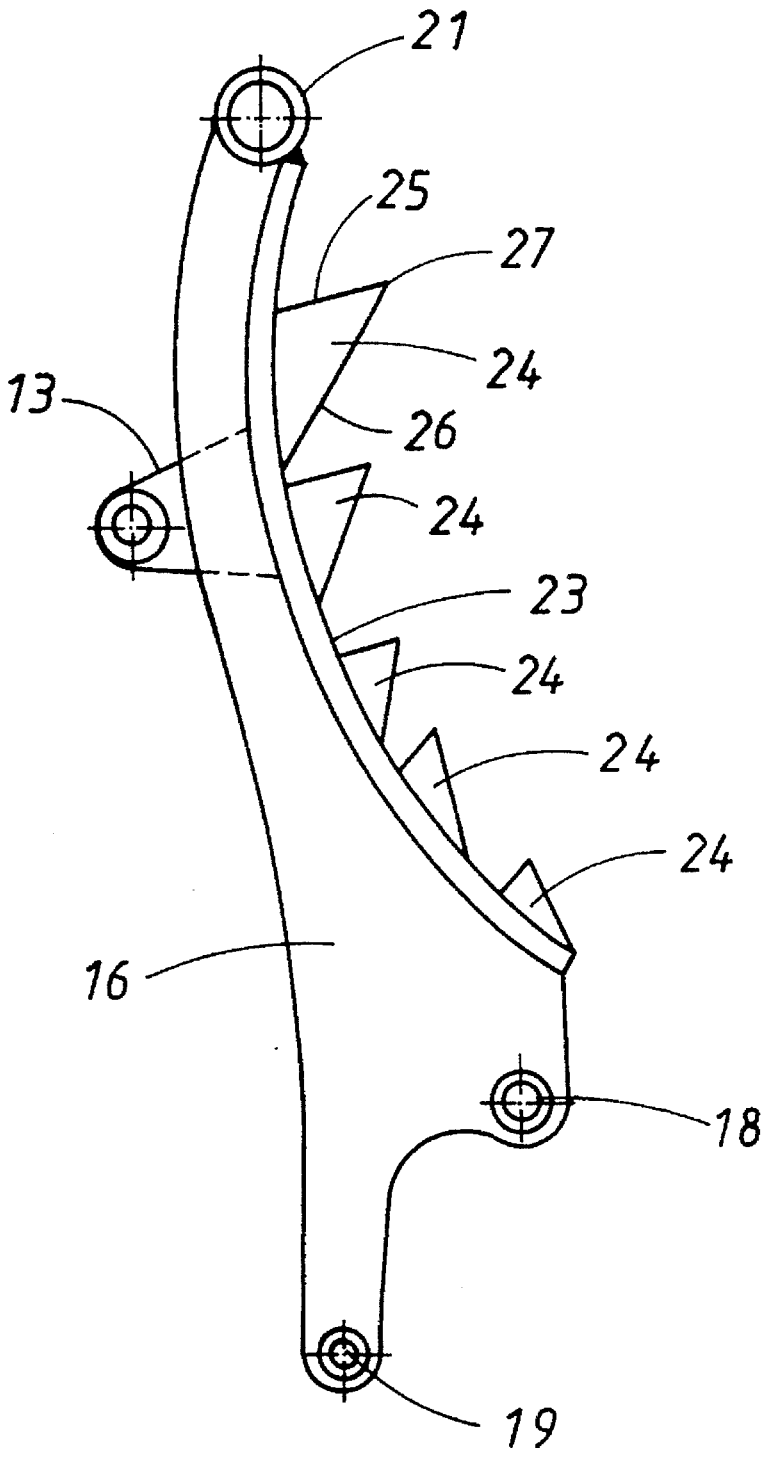
FIG. 4 is a side view of the arcuate impact plate as shown in FIGS. 3 and 4.

The structure of the arcuate impact plate 10 is specifically illustrated in FIGS. 2 to 4 of the drawings. FIG. 2 shows a perspective expanded view of a first side 12 of the arcuate impact plate 10 which side constitutes an outer side when the arcuate impact plate 10 is installed in the aforementioned comminuting machine 1. Brackets 13 rise from this first side 12 and serve to provide a linking connection for the installation of pressure fluid operated piston-cylinder units 14, 15. Such pressure fluid operated units 14, 15 are members of pressure fluid operated displacement means which may be provided in the event that, for example, further comminuting means are intended to be employed in the comminuting machine 1 in conjunction with the discharge opening 11.

Extending along the first side 12 of the arcuate impact plate 10 are carriers 16 which protrude beyond a first end 17 of the arcuate impact plate 10 which first end 17 constitutes a rear end as viewed in the rotational direction 7 of the rotary impact mechanism 3 when the arcuate impact plate 10 is installed in the comminuting machine 1. The protruding free ends of the carriers 16 are provided with respective link members 18 for connection to the just mentioned further comminuting means when installed in the comminuting machine 1.

Each free end of the carriers 16 also has a link member 19 for connection to a cover plate if the same is desired to be used. Such cover plate will be described further below with reference to FIG. 5 of the drawings. In the absence of such cover plate, the comminuted material is discharged through the discharge opening 11 of the housing or container rear part 2.

Furthermore, a second end 20 of the arcuate impact plate 10 is equipped with a tubular pivot bearing 21; this second end 20 represents the front end of the arcuate impact plate 10 when the same is installed in the comminuting machine 1. The pivot bearing 21 receives a pivot shaft 22 which is mounted at opposite side walls of the container rear part 2, only the side wall 20 being visible in FIG. 1.

FIG. 3 is a top plan view of a second side 23 of the arcuate impact plate 10 which second side 23 constitutes an inner side when the arcuate impact plate is installed in the comminuting machine 1. There will also be recognized the pivot bearing 21 at the second end 20 of the arcuate impact plate 10. This second side 23 of the arcuate impact plate 10 is provided with teeth 24 which are arranged in substantially transverse, substantially parallel rows 24A, 24B, 24C, 24D and 24E. It will be distinctly recognized that adjacent rows of teeth 24 are substantially transversely offset from each other. Specifically, the transverse offset is provided in a manner such that there is no lengthwise alignment between the teeth 24 of the different rows 24A, 24B, 24C, 24D and 24E of teeth 24.

In the side view of FIG. 4, the bracket 13 and the carrier 1 are clearly visible on the first side 12 of the arcuate impact plate 10. Also clearly visible is the structure of the teeth 24. Particularly, the teeth 24 are formed with a triangular cross-section in a manner such that a steeply rising flank 25 faces the bearing 21 while the other, less steeply descending flank 26 gradually drops off to the second side 23 of the arcuate impact plate 10. Due to the triangular cross-section, each tooth 24 defines a tip 27 which rises above the second side 23 of the arcuate impact plate 10. The height of the tip 27 above the second side 23 of the arcuate impact plate 10 decreases in a direction away from the pivot bearing 21. Consequently, the tips 27 of the teeth 24 define an arc which is eccentric with respect to the arc defined by the arcuate impact plate 10 or the second side 23 thereof from which the teeth 24 rise.

Returning now to FIG. 1 of the drawings, it will be seen that the front end 20 of the arcuate impact plate 10 is pivotably supported between the opposite side walls of the container rear part 2 by means of the pivot bearing 21. The rear end 17 of the arcuate impact plate 10 bears upon stops (not shown) which are provided at the opposite side walls of the container rear part 2. It will be recognized that the arcuate impact plate 10 is eccentrically arranged with respect to the top portion of the rotary impact mechanism 3 such that the spacing between the second or inner side 23 of the arcuate impact plate 10 and the substantially cylindrical area 9 of action of the rotary impact mechanism 3 decreases in the rotational direction 7 of the rotary impact mechanism 3. The height of the tips 27 of the teeth 24 decreases in the same direction. Although the tips 27 of the teeth 24 define an arc which is eccentric with respect to the arc defined by the second or inner side 23 of the arcuate impact plate 10, the arc defined by the tooth tips 27 also is eccentric with respect to the rotary impact mechanism 3. Consequently, the tips 27 of the teeth 24 and the rotary impact mechanism 3 or its substantially cylindrical area 9 of action define a throughpass gap 28 which decreases in the rotational direction 7 of the rotary impact mechanism 3. If desired, the tips 27 of the teeth 12 may be selected such that the throughpass gap 28 has a substantially constant width along its entire length.

In any event, the provision of the arcuate impact plate 10 has the result that either a continuously narrowing or constant throughpass gap 28 is defined and follows the contour of the substantially cylindrical area 9 of action of the rotating flails 5 of the rotary impact mechanism 3. This has the beneficial effect that the material which enters the throughpass gap 28 from the aforementioned entrance gap, is subjected to either a continuously increasing or constant comminuting action, as the case may be. This comminuting action is particularly intense because the material entering the throughpass gap 28 is thrown against and hits the steeply rising flanks 25 of the teeth 24. Since there are no axial spacings between the rotating flails 5, the material is subjected to a highly effective breaking or crushing action. Such action is additionally intensified due to the fact that there is no lengthwise or circumferential alignment between the teeth 24 on the second or inner side 23 of the arcuate impact plate 10 since the infed material thus is very effectively prevented from slipping through channels formed by lengthwisely or circumferentially aligned teeth.

At its second or front end 20 as viewed in the rotational direction 7, the impact plate 10 is pivotably supported at the side walls of the container rear part 2 by means of the pivot bearing 21,22. With its first or rear end 17 as viewed in the rotational direction 7, the impact plate 10 rests upon stops (not shown) located at the inner face of the opposite side walls of the container rear part 2. In this manner it will be ensured that non-disintegratable pieces of material like metallic articles or stones can not cause damage at the impact plate 10 because the impact plate 10 is pivotably raised about the pivot shaft 22 in the presence of such non-disintegratable pieces and thus permits the same to pass through the throughpass gap 28. This effect is assisted by the pivotable mounting of the rotating flails 5 at the drum 4.

As already indicated hereinabove with reference to FIG. 2 of the drawings, the first or outer side 12 of the arcuate impact plate 10 may be provided with pressure fluid operated displacing means or piston-cylinder units 14, 15 for operative connection to further comminuting means following the arcuate impact plate 10 and extending along the discharge opening 11 of the container rear part 2.

Figure 5:
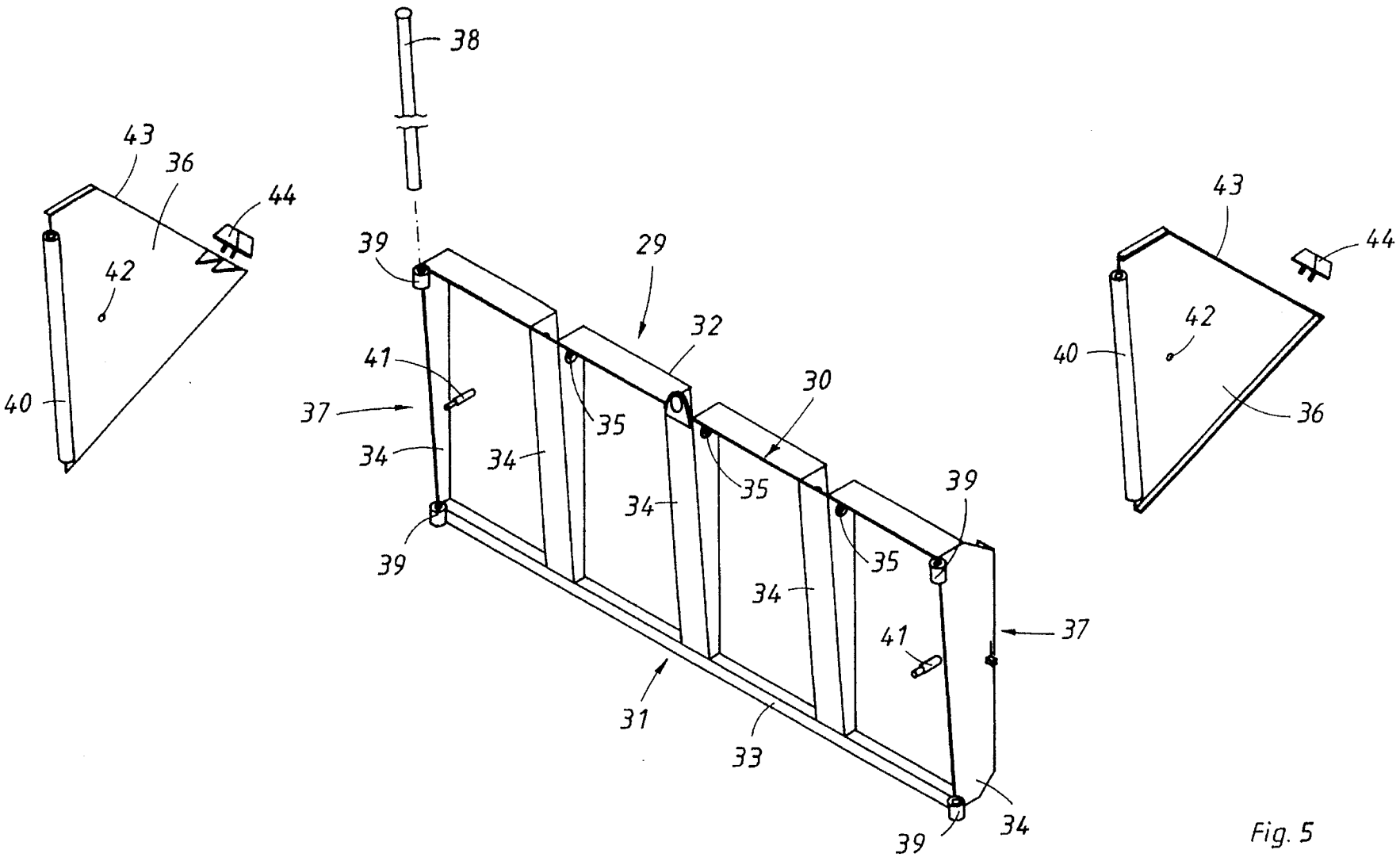
FIG. 5 is a perspective view of a cover plate used in the comminuting machine as shown in FIG. 1.

Furthermore, the discharge opening 11 of the comminuting machine 1 may be provided with a cover plate 29 and means for holding the cover plate 29 in a closed position and in an open position, see FIG. 5. Specifically, the cover plate 29 constitutes a plastic or sheet metal plate defining a front end 30 and a rear end 31 as viewed in the rotational direction 7 of the rotary impact mechanism 3. The ends 30, 31 are provided with respective reinforcements 32 and 33 extending therealong. The reinforcement 32 at the front end 30 is interrupted by further reinforcements 34 extending at mutual spacings between the reinforcements 32 and 33. The front ends of the reinforcements 34 contain linking holes 35 by means of which the cover plate 29 is linked to the link members 19 as shown in FIGS. 1, 2 and 4 at the free ends of the carriers 16 which extend along the first or outer side 12 of the arcuate impact plate 10.

In the inoperative state of the comminuting machine 1, the cover plate 29 closes the discharge opening 11 of the comminuting machine 1 by being dependent from the link members 19. Holding means of suitable conventional construction, particularly spring loaded holding means, are provided at the lower portion of the container rear part 2 for holding the dependent cover plate 29, if desired, during travel of the comminuting machine 1 between different working locations.

Trapezoidally shaped support members 36 are pivotably mounted at lateral sides 37 of the cover plate 29. Respective pivot shafts 38 extend through respective eyes 39 fixed to the four corners of the cover plate 29, and a pivot bearing 40 mounted at the associated sides of the respective support members 36. The outer side of the cover plate 29 has affixed thereto two holding pins 41 which are received in associated holes 42 of the support members 36. Linch pins or equivalent means are used to secure the support members 36 in the inwardly pivoted position in the inoperative state of the comminuting machine 1.

In the operative state of the comminuting machine 1, the cover plate 29 is upwardly pivoted about the link connection at the link members 19 of the carriers 16 and the support members 36 are released from the holding pins 41. The support members 36 are pivoted about the respective bearing shafts 38 into a position in which their edges 43 abut the outer side of the container rear part 2. Rubber or plastic buffers 44 are provided at the edges 43 for preventing damage. Consequently, the cover plate 29 is supported at the container rear part 2 in an upwardly pivoted position such that the cover plate 29 extends in downward direction from the first or rear end 17 of the arcuate impact plate 10. It is thereby achieved that any upwardly directed comminuted material which issues from the discharge opening 11 of the comminuting machine 1, is downwardly deflected toward the stack or pit of accumulating comminuted material.

Like the initially mentioned mobile comminuting machines, the inventive comminuting machine may also be equipped with the known overload coupling and/or overload control means which respond to an overload at the rotary impact mechanism. As explained hereinbefore, such overload coupling mainly acts to dampen rapid transient variations in the rotational speed of the rotary impact mechanism and prevents the same from affecting the prime mover whereas the overload control means react to the overload by decelerating and eventually stopping the infeed drive means driving the infeed means to convey the infed material to the rotary impact mechanism.

While there are shown and described present preferred embodiments of the invention, it is to be distinctly understood that the invention is not limited thereto, but may be otherwise variously embodied and practiced within the scope of the following claims.

What I claim is:

1. An impact plate for use in a comminuting machine in cooperation with a rotary impact mechanism, comprising:

an arcuate plate defining a first side and a second side;

said arcuate plate subtending about a predetermined arc;

a plural number of substantially transverse, substantially parallel rows of teeth rising from said second side of said arcuate plate;

said substantially transverse, substantially parallel rows of teeth being offset from each other in a substantially transverse direction;

said arcuate impact plate defining a first end and a second end and a lengthwise direction extending between said first end and said second end; and said teeth in said transverse rows of teeth are out of alignment with each other in said lengthwise direction.

2. The impact plate as defined in claim 1, wherein said predetermined arc extends about an angle in the range of 40° to 120°.

3. The impact plate as defined in claim 1, wherein:

said teeth have a substantially triangular cross-section;

said triangular cross-section defining a steeply rising flank and a less steeply descending flank;

said steeply rising flank facing said second end of said arcuate plate; and said less steeply descending flanks facing said first end of said arcuate plate.

4. The impact plate as defined in claim 3, wherein:

said triangular cross-section of said teeth defines a tip;

each said tips of said teeth assuming a height above said second side of said arcuate plate; and said height of said tips above said second side of said arcuate plate decreasing in said lengthwise direction of said arcuate plate.

5. The impact plate as defined in claim 4, wherein said tips of said teeth define an arc which is eccentric relative to said predetermined arc about which said arcuate plate extends.

6. The impact plate as defined in claim 1, further including:

a plural number of carriers; and said plural number of carriers being secured to said first side of said arcuate plate and extending along said first side of said arcuate plate in its lengthwise direction.

7. The impact plate as defined in claim 6, wherein:

each one of said plural number of carriers has a free end protruding over said first end of said arcuate plate and being provided with link members.

8. The impact plate as defined in claim 6, further including at least two brackets rising from said first side of said arcuate plate and spaced from each other for connection to respective pressure fluid operated piston-cylinder units.

9. The impact plate as defined in claim 8, wherein respective pressure fluid operated piston-cylinder units are linked to said brackets.

10. The impact plate as defined in claim 1, further including:

a pivot bearing for pivotably mounting said arcuate plate; and said pivot bearing being secured to said second end of said arcuate plate.

11. The impact plate as defined in claim 10, wherein said pivot bearing constitutes a tubular pivot bearing for receiving a pivot shaft.

12. A comminuting machine comprising:

a housing for receiving material to be comminuted;

a rotary impact mechanism disposed in said housing and defining a rotational direction;

an arcuate impact plate arranged in said housing and extending along a predetermined arc above a top portion of said rotary impact mechanism generally in said rotational direction for cooperation with said rotary impact mechanism; and said housing having a discharge opening which immediately follows said arcuate impact plate in said rotational direction defined by said rotary impact mechanism and through which comminuted material is immediately discharged from the housing.

13. A comminuting machine comprising:

a housing for receiving material to be comminuted;

a rotary impact mechanism disposed in said housing and defining a rotary direction;

an arcuate impact plate arranged in said housing and extending along a predetermined arc above a top portion of said rotary impact mechanism generally in said rotational direction for cooperation with said rotary impact mechanism;

said housing having a discharge opening which immediately follows said arcuate impact plate and through which comminuted material is immediately discharged from the housing;

said arcuate impact plate defines an inner side facing said rotary impact mechanism;

a plural number of substantially transverse, substantially parallel rows of teeth rising from said inner side of said arcuate impact plate;

said substantially transverse, substantially parallel rows of teeth being offset from each other in substantially transverse direction;

said arcuate impact plate defining a front end and a rear end as viewed in said rotational direction of said rotary impact mechanism;

said arcuate impact plate defining a lengthwise direction extending between said front end and said rear end of said arcuate impact plate; and said teeth in said transverse rows of teeth are out of alignment with each other in said lengthwise direction.

14. The comminuting machine as defined in claim 13, wherein:

said teeth have a substantially triangular cross-section;

said triangular cross-section defining a steeply rising flank and a less steeply descending flank;

said steeply rising flank facing said front end of said arcuate impact plate; and said less steeply descending flank facing said rear end of said arcuate impact plate.

15. The comminuting machine as defined in claim 14, wherein:

said triangular cross-section of said teeth defines a tip;

said tips of said teeth assuming a height above said inner side of said arcuate impact plate; and said height of said tips above said inner side of said arcuate impact plate decreasing in said rotational direction of said rotary impact mechanism.

16. The comminuting machine as defined in claim 15, wherein:

said tips of said teeth define an arc which is eccentric relative to said predetermined arc about which said arcuate impact plate extends, and relative to said rotary impact mechanism; and said tips of said teeth and said rotary impact mechanism define a throughpass gap which narrows toward said rear end of said arcuate impact plate.

17. The comminuting machine as defined in claim 15, wherein:

said tips of said teeth define an arc which is eccentric relative to said predetermined arc about which said arcuate impact plate extends, and substantially concentric relative to said rotary impact mechanism; and said tips of said teeth and said rotary impact mechanism conjointly define a throughpass gap of substantially constant width toward said rear end of said arcuate impact plate.

18. The comminuting machine as defined in claim 13, further including:

a pivot bearing for pivotably mounting said arcuate impact plate; and said pivot bearing being secured to said front end of said arcuate impact plate.

19. The comminuting machine as defined in claim 18, wherein:

said housing has opposite side walls;

said pivot bearing including a pivot shaft extending between said opposite side walls and received by said pivot bearing at said front end of said arcuate impact plate.

20. The comminuting machine as defined in claim 13, wherein said predetermined arc defined by said arcuate impact plate above said top portion of said rotary impact mechanism, extends about an angle in the range of 40° to 120°.

21. The comminuting machine as defined in claim 13, wherein said predetermined arc defined by said arcuate impact plate above said top portion of said rotary impact mechanism, is eccentric relative to the rotary impact mechanism.

22. The comminuting machine as defined in claim 13, further including:

a plural number of carriers;

said arcuate impact plate defining an outer side remote from said rotary impact mechanism; and said plural number of carriers being secured to said outer side of said arcuate impact plate and extending along said outer side of said arcuate impact plate in said rotational direction of said rotary impact mechanism.

23. The comminuting machine as defined in claim 22, further including at least two brackets rising from said outer side of said arcuate impact plate and spaced from each other for connection to respective pressure fluid operated piston-cylinder units.

24. The comminuting machine as defined in claim 23, wherein respective pressure fluid operated piston-cylinder units are linked to said brackets.

25. The comminuting machine as defined in claim 22, wherein:

each one of said plural number of carriers has a free end protruding over said rear end of said arcuate impact plate and being provided with link members.

26. The comminuting machine as defined in claim 25, further including:

a cover plate defining opposite lateral sides and a front end and a rear end;

said front end of said cover plate being linked to said free ends of said carriers protruding from said rear end of said arcuate impact plate;

said cover plate being pivotable between a first position in which the cover plate essentially covers the discharge opening of said housing, and a second position in which said cover plate is upwardly pivoted into an open position; and said cover plate, in said open position thereof, extending at a downwardly directed inclination.

27. The machine as defined in claim 26, further including:

support members pivotably mounted at said opposite lateral sides of said cover plate;

each one of said support members defining a support edge;

said housing defining an outer side adjacent said discharge opening; and said support edge of said support members supporting said cover plate at said housing in said upwardly pivoted position of said cover plate.

* * * * *